US006998788B2

(12) United States Patent
Sun

(10) Patent No.: US 6,998,788 B2
(45) Date of Patent: Feb. 14, 2006

(54) ARCHITECTURE OF DATA DRIVER APPLIED AT DISPLAY ELEMENTS WITH CURRENT-DRIVEN PIXELS

(75) Inventor: Wein-Town Sun, Kaohsiung (TW)

(73) Assignee: AU Optronics Corporation, Hsin-Chu (TW)

( * ) Notice: Subject to any disclaimer, the term of this patent is extended or adjusted under 35 U.S.C. 154(b) by 48 days.

(21) Appl. No.: 10/459,096

(22) Filed: Jun. 11, 2003

(65) Prior Publication Data

US 2004/0251840 A1 Dec. 16, 2004

(51) Int. Cl.
*G09G 3/10* (2006.01)

(52) U.S. Cl. ..... 315/169.2; 315/169.3; 315/224

(58) Field of Classification Search ..... 315/169.3, 315/169.2, 209 R, 224; 345/36, 45, 76, 82
See application file for complete search history.

(56) References Cited

U.S. PATENT DOCUMENTS

| | | | | |
|---|---|---|---|---|
| 5,920,154 | A * | 7/1999 | Hush | 315/169.1 |
| 6,760,004 | B1 * | 7/2004 | Koyama | 345/98 |
| 6,841,948 | B1 * | 1/2005 | Yoshida | 315/169.3 |
| 2003/0058204 | A1 * | 3/2003 | Moon | 345/87 |
| 2004/0100399 | A1 * | 5/2004 | Sun | 341/153 |
| 2005/0030264 | A1 * | 2/2005 | Tsuge et al. | 345/76 |

OTHER PUBLICATIONS

Beasely, et al., "Transistor Level Implementation ofCMOS Combinational Logic Circuits," Technology Interface/ Spring 97, 16 pages.
Shimoda, et al., "16-1: A Poly-Si TFT 6-bit Current Data Driver for Active Matrix Organic Light Emittign Diode Desplays," Eurodisplay 2002, 279-282.

* cited by examiner

*Primary Examiner*—Trinh Vo Dinh
(74) *Attorney, Agent, or Firm*—Duane Morris LLP

(57) ABSTRACT

A device for controlling current useful for driving an organic light emitting diode (OLED) is disclosed which comprises a driver further comprising a switching circuit and a capacitor operatively connected to the switching circuit. The capacitor serves to maintain $V_{GS}$ for at least one component of the switching circuit. During operation of an exemplary embodiment, current to a pixel may be controlled by providing a sampling stage, during which the capacitor may be charged and/or discharged; providing a data current outputting stage during which summed current from each switching circuit may be provided to the pixel; and providing a pixel current reproducing stage during which each pixel is allowed to emit light in the presence of current in the data line. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

9 Claims, 8 Drawing Sheets

ARCHITECTURE OF DATA DRIVER APPLIED AT DISPLAY ELEMENTS WITH CURRENT-DRIVEN PIXELS

FIELD OF INVENTION

The present invention relates to drivers suitable to transform digital data into currents for controlling pixels in a display.

BACKGROUND OF THE INVENTION

Flat panel monitors eliminate the electron beam and vacuum tube found in conventional displays, replacing them with a grid of pixels. Referring now to FIG. 1, in typical prior art drivers for pixels in such flat panel monitors, it is necessary to have latches and level shifters in every stage driver. This consumes power.

In certain prior art arrangements, current copiers and other circuits are used in the current signal circuitry block of data drivers, e.g. for OLED devices. A problem with these prior art devices, e.g. FIG. 1, is that latches and level shifters are also required in many such circuits, e.g. current copier circuits, current mirror circuits, and the like. Further, typical digital-to-current circuitry of the prior art allows power source and current copier stage data drivers to be connected momentarily, resulting in resistive power consumption. Transferring digital data signals from flexible printed circuit (FPC) pins to every data driver throughout the video lines may also result in dynamic power consumption. Additionally, sampling and amplifying digital signals may require latches and level shifters in each stage driver. At times, small level digital signals may not be transferred to an appropriate driver circuit.

Reduction in power consumption is especially desirable for organic light emitting diode (OLED) devices. Allowing digital signals to be input and optionally amplified, e.g. by level shifters, without a need for latches and level shifters driving every stage reduces the power requirements and power consumption of these devices.

DETAILED DESCRIPTION OF A PREFERRED EMBODIMENT

Figure 1:
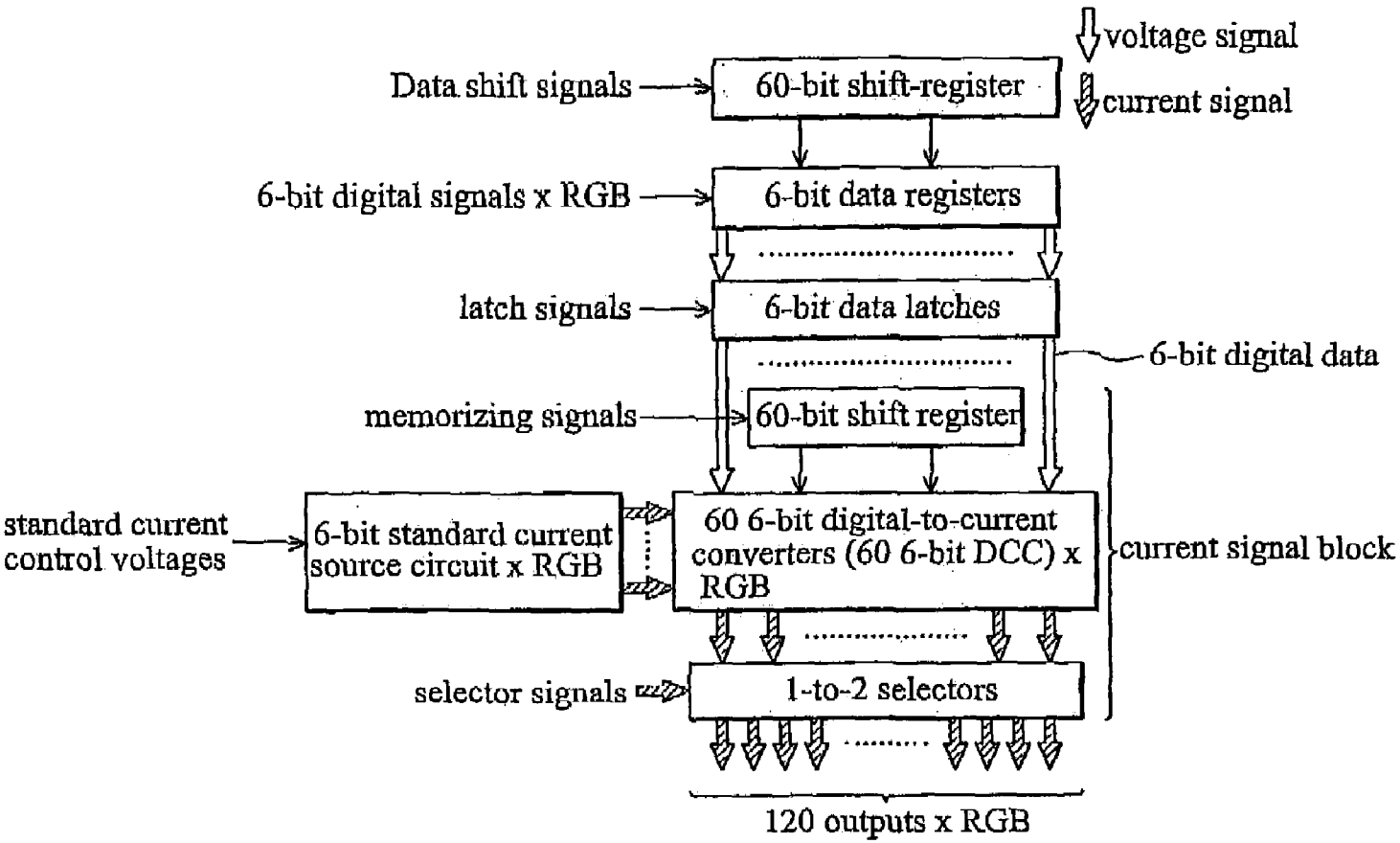
FIG. 1 is a schematic overview of an exemplary prior art circuit for controlling current in a digital-to-current converter.
Figure 2:
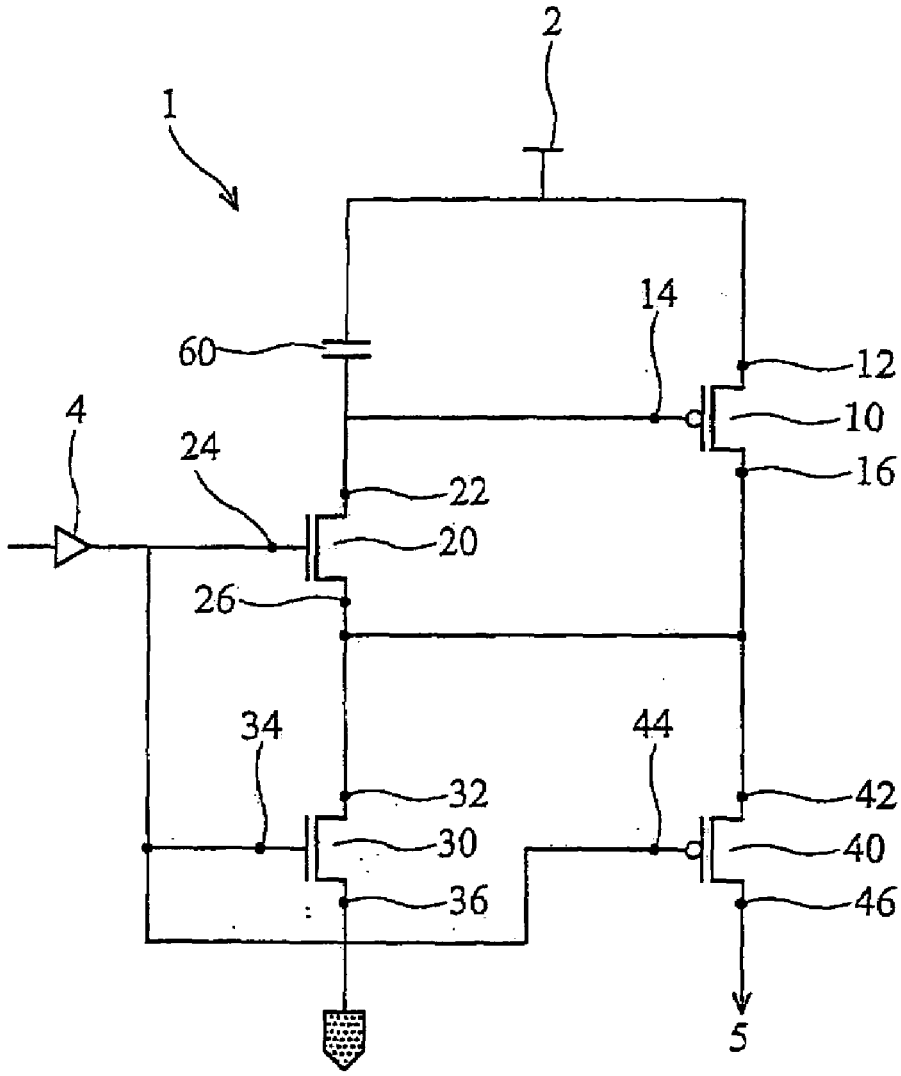
FIG. 2 is a schematic overview of a first exemplary circuit of the present invention for controlling current in a digital-to-current converter.
Figure 3:
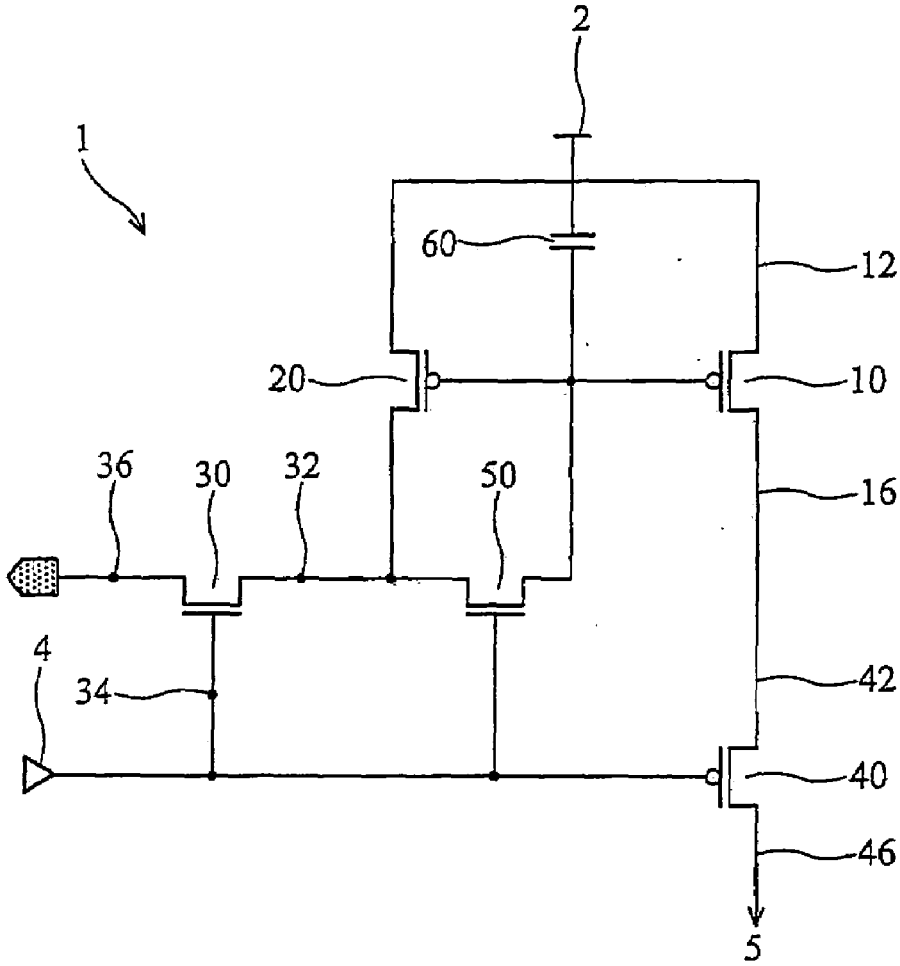
FIG. 3 is a schematic overview of a second exemplary circuit of the present invention for controlling current in a digital-to-current converter.

Several drivers 1 are illustrated in FIGS. 2 and 3. Although many configurations may be possible, only two embodiments will be described herein. In general, driver 1

(FIG. 2 and FIG. 3) may be used to store voltage $V_{GS}$ which may exist between a gate and a source of a CMOS transistor, e.g. first active device 10 (FIG. 2 or FIG. 3). This voltage storing function may then be used transform current, e.g. from power source 2 (FIG. 2 or FIG. 3), to a predetermined voltage, e.g. the stored $V_{GS}$ voltage. A current could be reproduced using the stored $V_{GS}$ voltage.

Referring now to FIG. 2, control current such as may be useful for driving an organic light emitting diode (OLED). In an embodiment illustrated in FIG. 2, driver 1 is a current copier device and comprises first active device 10 which further comprises an output, e.g. drain 16, and is adapted to operatively connect to power source 2, e.g. $V_{DD}$; second active device 20, operatively connected to first active device 10 and to preceding device 4; third active device 30, operatively connected to second active device 20, first active device 10, and preceding device 4; fourth active device 40, operatively connected to first active device 10 and preceding device 4; and $V_{GS}$ storage device 60, operatively connected to power source 2, second active device 20, and power source 2. In a preferred embodiment, $V_{GS}$ storage device 60 comprises a capacitor. Third active device 30 may further be operatively connected to controlling power source 3 (not shown in FIG. 2) Further, preceding device 4, as illustrated in FIG. 2, may be a shift register and controlling power source 3 may be a control current sink.

First active device 10, second active device 20, third active device 30, and fourth active device 40 may each be a transistor. In a preferred embodiment, first active device 10 and fourth active device 40 are P-type transistors and second active device 20 and third active device 30 are N-type transistors.

First active device 10 may further comprise source 12 connected to power source 2, gate 14 connected to second active device 20 and capacitor 60, and drain 16 operatively connected to fourth active device 40 and data line output 5 (FIG. 4), second active device 20, and third active device 30 (FIG. 2).

Second active device 20 may further comprise drain 22 connected to capacitor 60, gate 24 operatively connected to preceding device 4, and source 26 connected to third active device 30 and to drain 16 of first active device 10.

Third active device 30 may further comprise drain 32 connected to source 26 of second active device 20 and drain 16 of first active device 10, gate 34 connected to gate 24 of second active device 20 and preceding device 4, and source 36 connected to control power source 3.

Figure 4:
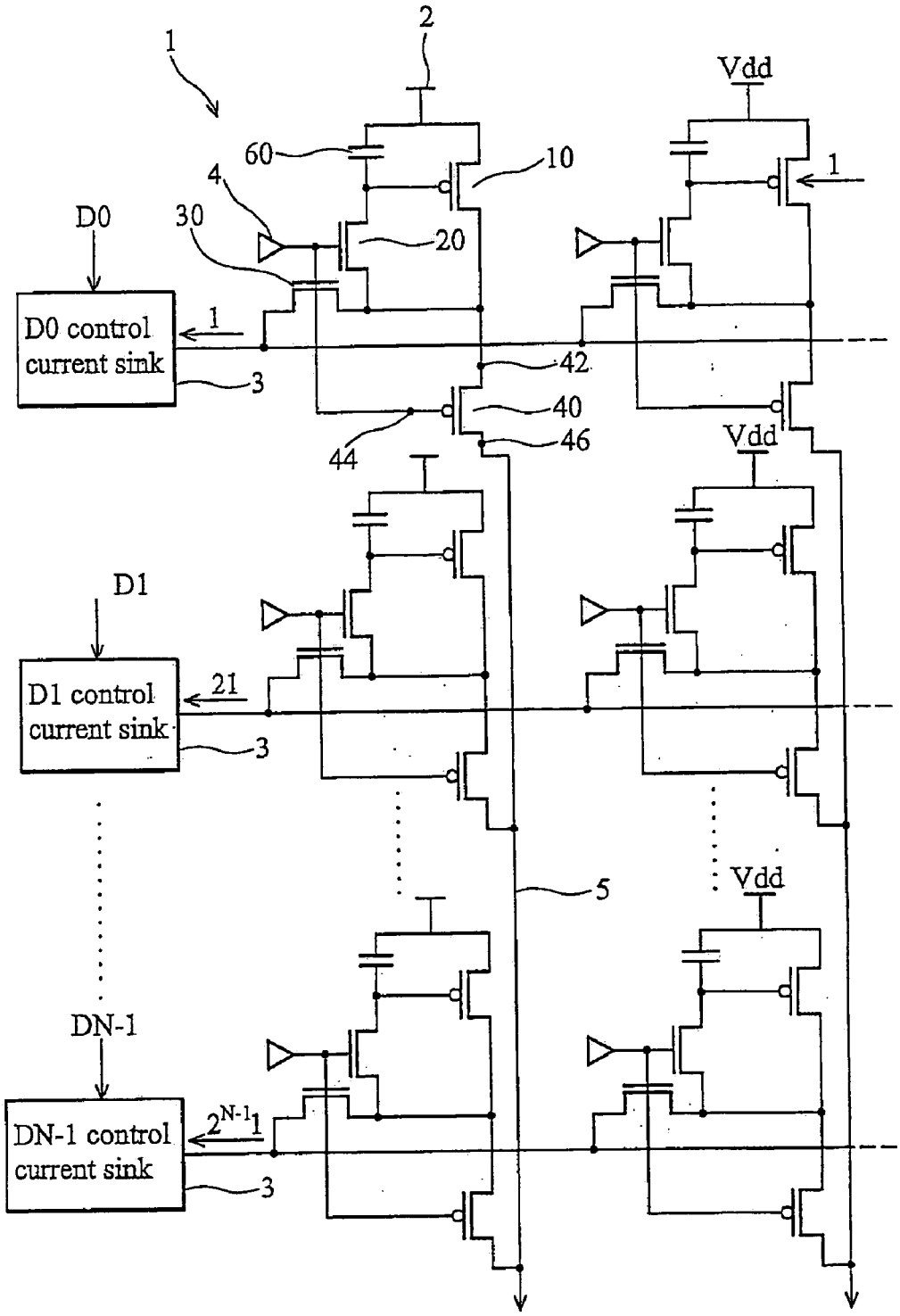
FIG. 4 is a schematic overview of an exemplary circuit for controlling current in a digital-to-current converter of the present invention.

Fourth active device 40 may further comprise source 42 connected to drain 16 of first active device 10, gate 44 connected to preceding device 4 (FIG. 2), and drain 46 connected to data line output 5 (FIG. 4).

In an embodiment illustrated in FIG. 3, driver 1 is a current mirror device and comprises first active device 10 which further comprises an output, e.g. drain 16, and is adapted to operatively connect to power source 2, e.g. $V_{DD}$; second active device 20, operatively connected to first active device 10 and to power source 2; third active device 30, operatively connected to second active device 20 and preceding device 4; fourth active device 40, operatively connected to first active device 10 and preceding device 4; fifth active device 50, operatively connected to first active device 10, second active device 20, third active device 30, fourth active device 40, and preceding device 4; and capacitor 60, operatively connected to power source 2, first active device 10, second active device 20, third active device 20, fourth active device 40, and fifth active device 50. Third device 30 may be operatively connected to controlling power source 3

(not shown in FIG. 3). Further, preceding device 4, as illustrated in FIG. 3, may be a shift register and controlling power source 3 may be a control current sink.

First active device 10, second active device 20, third active device 30, fourth active device 40, and fifth active device 50 may each be a transistor. In a preferred embodiment, first active device 10, second active device 20, and fourth active device 40 are P-type transistors and third active device 30 and fifth active device 50 are N-type transistors.

Referring now to FIG. 4, several drivers 1 are illustrated in a circuit configuration. Preceding device 4, as illustrated in FIG. 4, may be a shift register. As further illustrated, each driver 1 or a group of drivers 1 may be operatively connected to a single controlling power source 3 or to separate controlling power sources 3. Further, a group of drivers 1 may be organized into rows and columns where each driver 1 that is a member of a column has its switching circuit connected to a common output of horizontal shift register 4 and each driver 1 of a row is connected to a common output of controlling power source 3. Thus, the first row may be connected to controlling power source 3 which provides input Do to control current T to inpour or stream the current power source, the next row to controlling power source 3 which provides input $D_1$ to control current 2I to inpour or stream, and the $N^{th}$ row to controlling power source 3 which provides input $D_{(N-1)}$ to control current $2^{(N-1)}$I to inpour or stream. As used herein, "switching circuit" is understood to be a component of driver 1 and may be either a current copier or current mirror configuration as described above.

As further illustrated in FIG. 4, each driver 1 may be cascaded with other drivers 1, e.g. drain 46 of fourth active device 40 may be connected to data line output 5 along with drain 46 of other fourth active devices 40 of other drivers 1.

Figure 5:
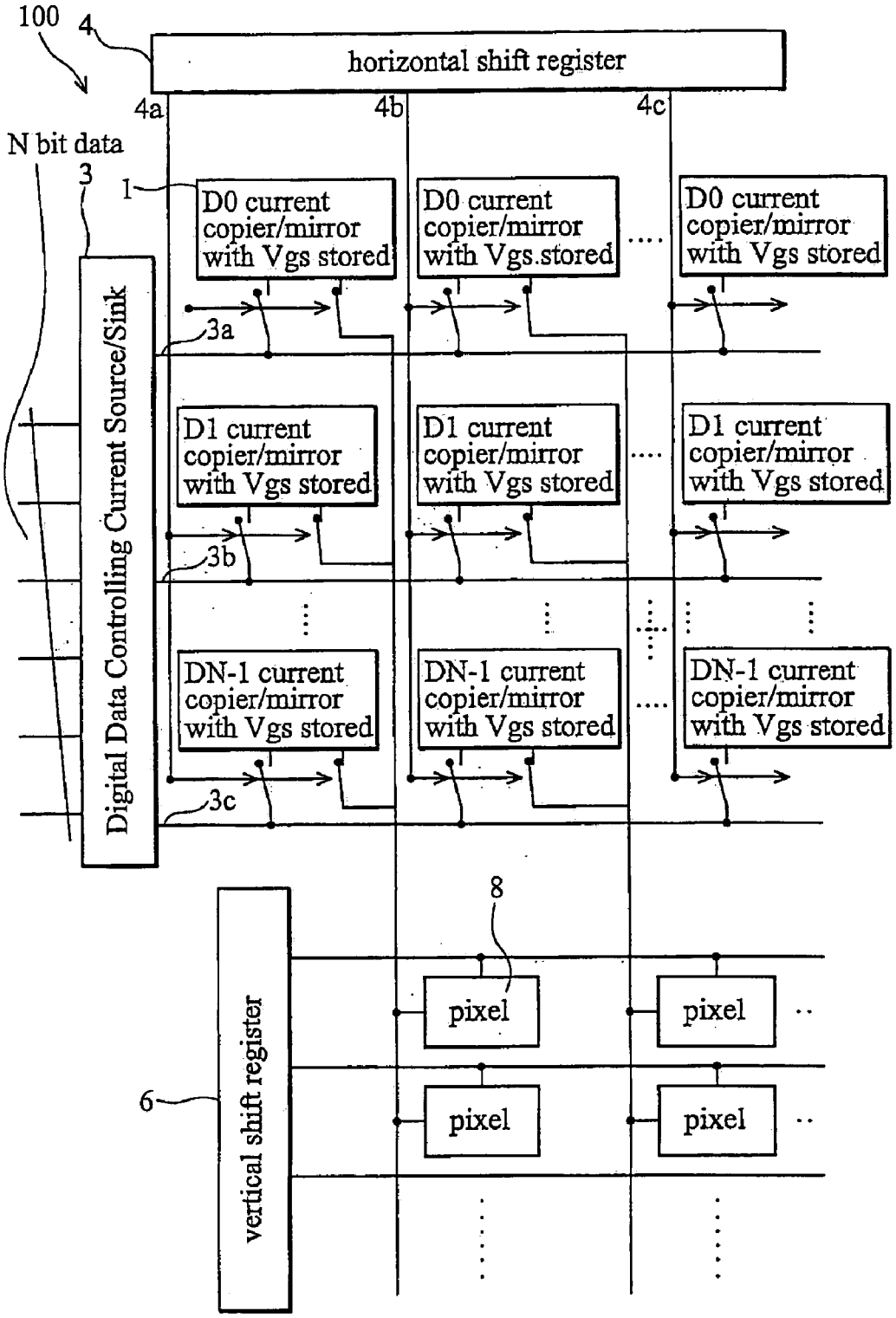
FIG. 5 is a schematic overview of an exemplary system for controlling current in an OLED of the present invention.

Referring now to FIG. 5, system 100 for supplying a data line signal useful for controlling an OLED pixel may comprise a digital logic signal input device which may comprise horizontal shift register 4, further comprising a plurality of shift register outputs 4*a*, 4*b*, 4*c*; digital data controlling power source/sink 3; and at least one driver 1 for each of the plurality of shift register outputs 4*a*, 4*b*, 4*c*. As noted above, controlling power source 3 may further comprise a plurality of controlling power sources 3*a*, 3*b*, 3*c*. In a preferred embodiment, each driver 1 in system 100 is of an identical configuration.

Additional circuitry may be present as well to supply needed circuitry for the OLED device, e.g. vertical shift register 6, pixels 8, and scan lines. In a preferred embodiment, current to pixel 8 may be controlled by device 1.

Figure 6A:
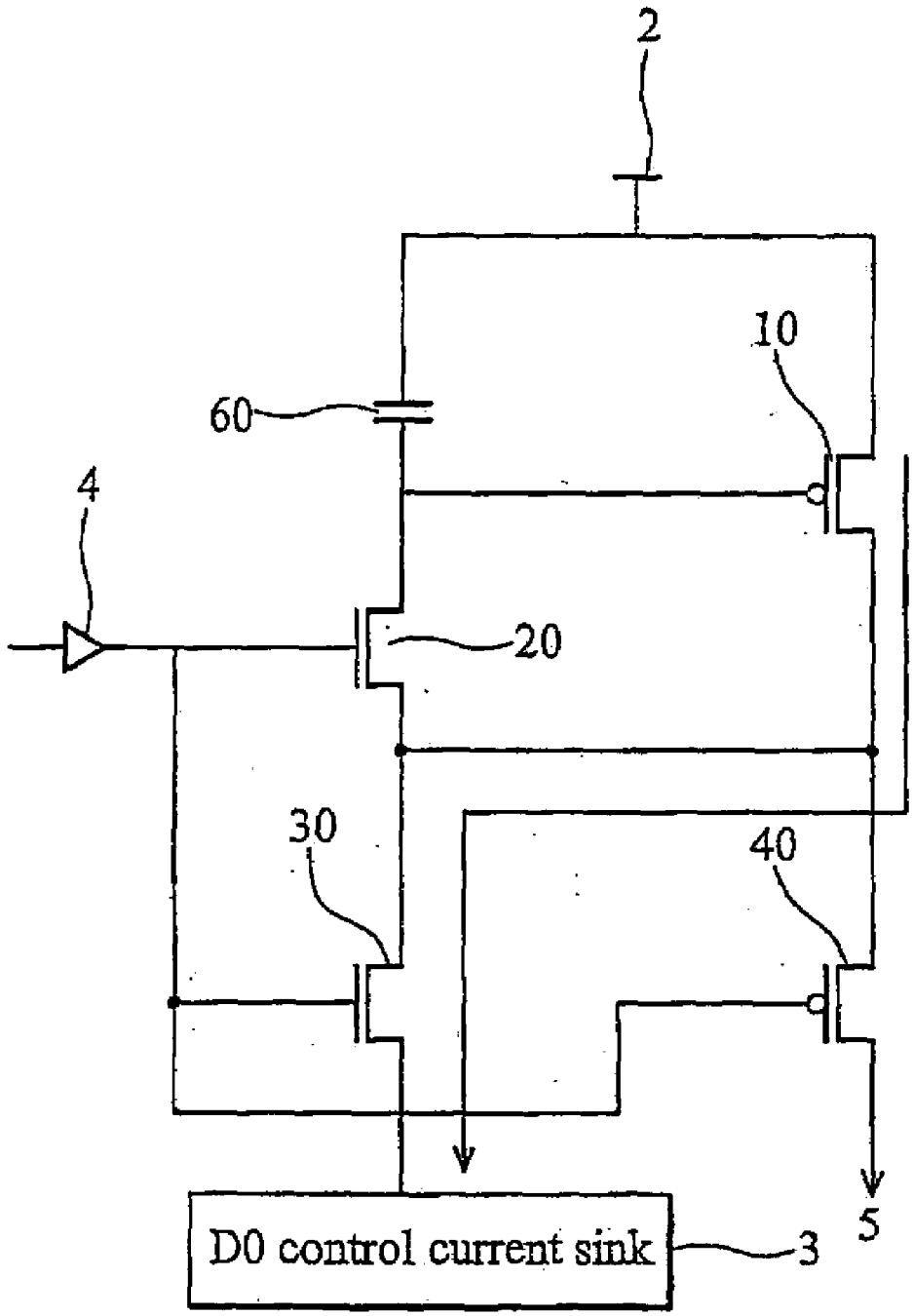
FIGS. 6*a* and 6*b* are schematic illustrations of the operation of a driver for digital data signals.
Figure 6B:
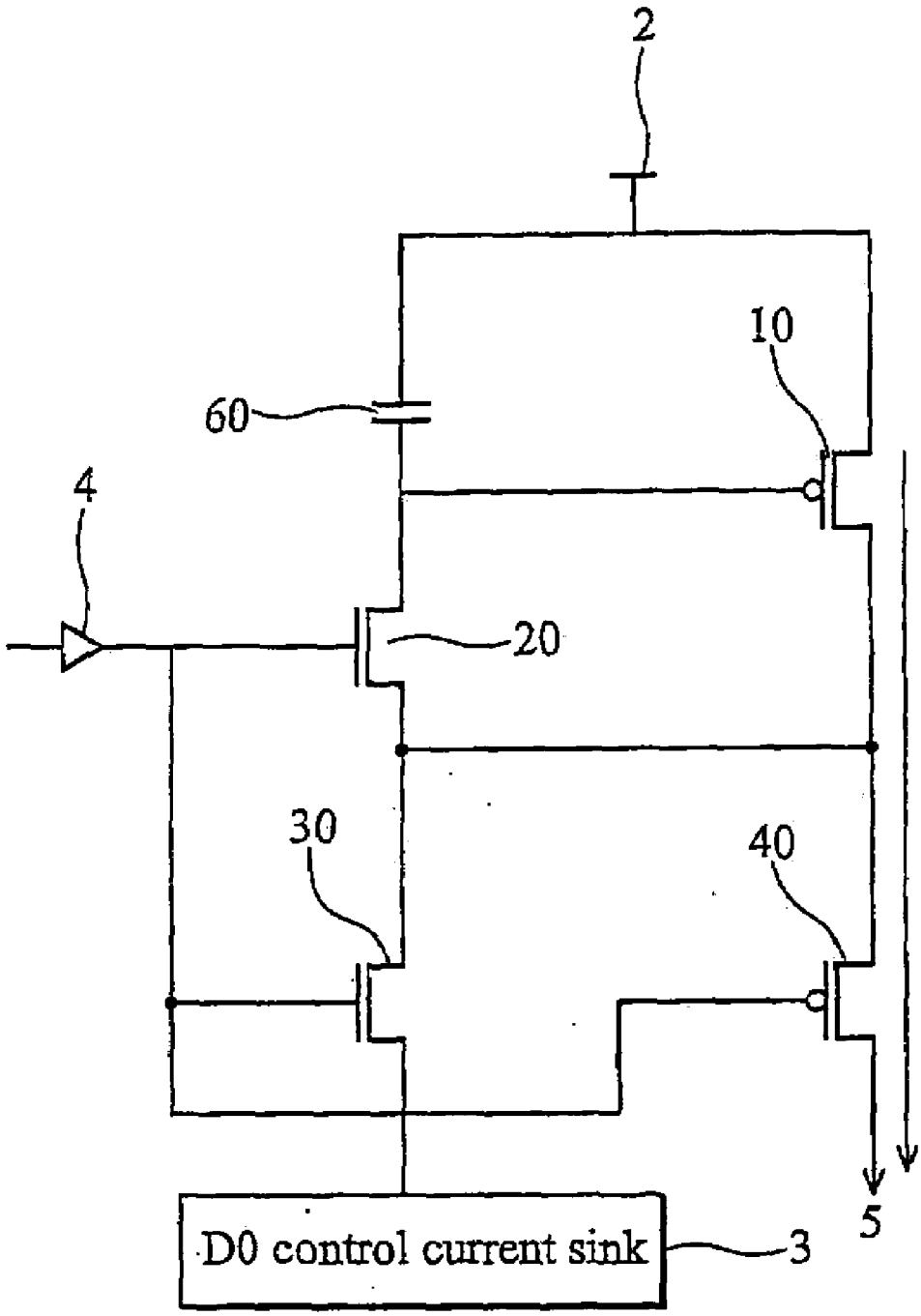

In the operation of an exemplary embodiment, referring now to FIGS. 6*a* and 6*b*, current through driver 1 may be controlled at a sampling stage and at an outputting stage. As will be familiar to those of ordinary skill in the semiconductor arts, a transistor, e.g. active device 20, may be used as a switch having an open state and a closed state. Digital signals may therefore be input and then amplified by level shifters and then enter controlling power source 3. Digital signals may be of less power than analog signals and will not transfer into every stage data driver through video lines. Further, latches and level shifters are not needed for driving every stage. As a result, power consumption may decrease over the prior art.

FIG. 6*a* and FIG. 6*b* illustrate using a current copier embodiment of driver 1. Pixels 8 may be controlled by providing a sampling stage, a data current outputting stage, and a pixel current reproducing stage.

In a data sampling stage, a digital logic signal arising from a source of a digital logic signal may be provided to control power source 3. If the digital logic signal goes high, a current path will be provided to second active device 20 and third active device 30 should they be enabled, i.e. placed into their closed state. A control signal may be provided from each output of horizontal shift register 4 to a corresponding input of second active device 20 and third active device 30, thus enabling second active device 20 and third active device 30. Accordingly, controlling power source 3 will control current through first active device 10, allowing current to flow through the switching circuit driver 1 in the presence of a digital high signal from digital data controlling current source/sink 3.

Concurrently, active device 40 is in its open state, blocking the digital logic signal, e.g. a logical "0." This allows current from power source 3 to be maintained through first active device 10 to source 36 of third active device 30 while simultaneously being blocked from flowing through fourth active device 40.

Capacitor 60, acting as a $V_{GS}$ storage device, will be charged in the presence of a digital high signal from digital data controlling current source/sink 3. Further, capacitor 60 will be discharged in the presence of a digital low signal from digital data controlling current source/sink 3. When capacitor 60 is discharged, voltage $V_{GS}$ supplied by capacitor 60 will drop to a level below which the switching circuit, e.g. active device 10, will be disabled and current will no longer flow through the switching circuit, e.g. active device 10.

As will be familiar to those in the art, one or more level shifters may be located ahead of driver 1. Before signals are input into controlling power source 3, data signals may thus be amplified and then input to controlling power source 3 to control output from controlling power source 3.

During a data current outputting stage, current from power source 2 may be permitted to flow through fourth active device 40 while being blocked from flowing through second active device 20 or third active device 30. The configuration of device 1 allows the voltage between gate 14 and source 12, $V_{GS}$, to be stored in capacitor 60, e.g. to be charged when the digital logic signal is high. If the digital logic signal goes low, second active device 20 and third active device 30 are placed into their open state and fourth active device 40 placed into its closed state. The stored voltage in capacitor 60 will then help maintain $V_{GS}$, which then controls first active device 10. Accordingly, during an outputting stage, a digital logic signal may be provided through fourth active device 40 and blocked from controlling power source 3 by disabling second active device 20 and third active device 30 and enabling fourth active device 40.

As a plurality of drivers 1 may be connected and provide current to a single data line, e.g. data line output 5, during the outputting stage current from each such driver 1 may be summed and provided to pixel 8 operatively connected to the data line, e.g. data line output 5.

Figure 7:
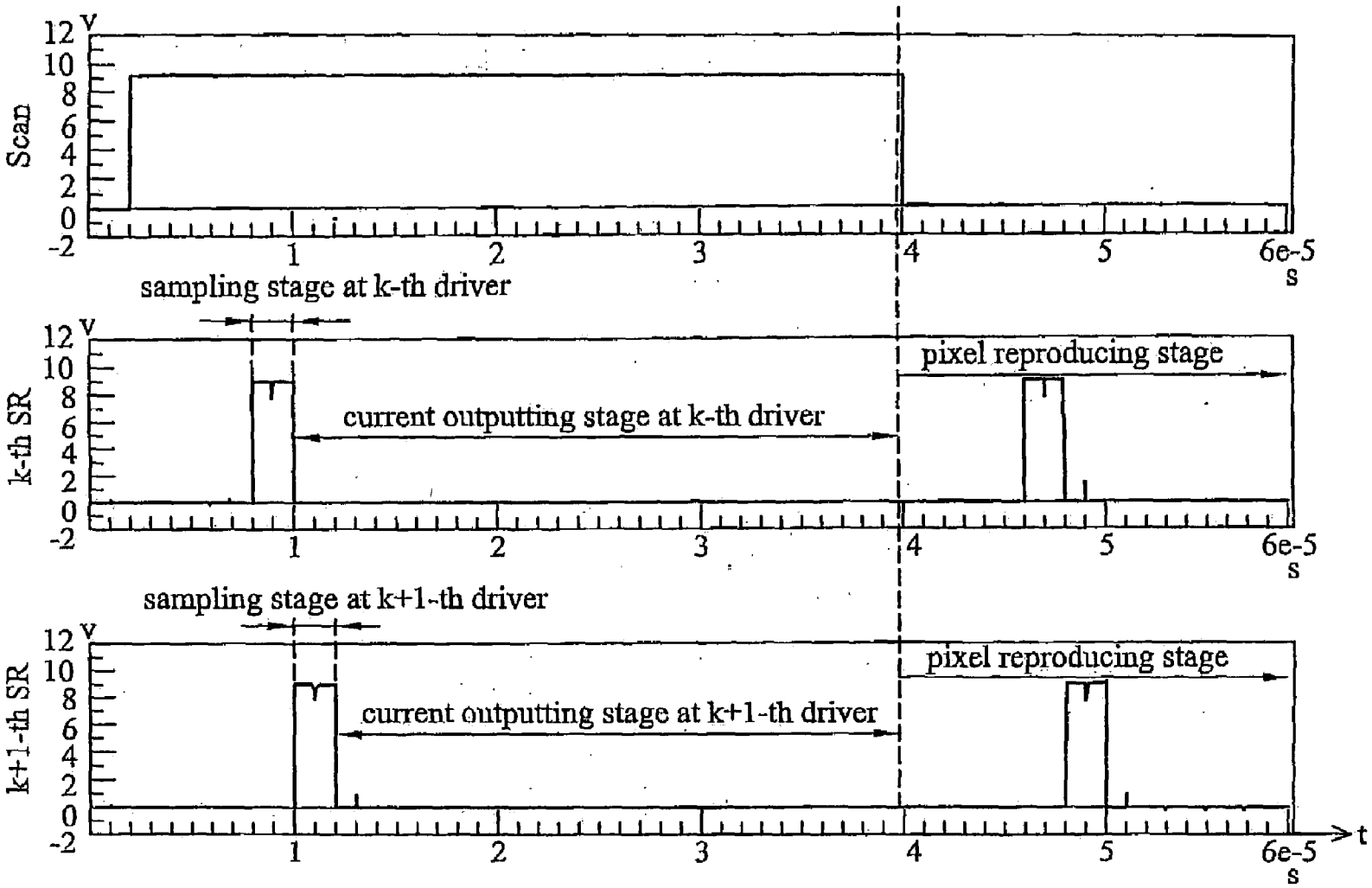
FIG. 7 is a timing diagram of an exemplary embodiment.

Referring now to FIG. 7, in an embodiment the data sampling stage is provided for driver 1 when the data signal from a $(k+1)^{th}$ horizontal shift register 4 is in a logical low state and the data signal from the previous sequential horizontal shift register, e.g. $k^{th}$ horizontal shift register 4, is in a logical high stage. The data current outputting stage may be provided when the data signal from the $k^{th}$ horizontal shift register 4 for that driver is in a logical low state and the data signal from the next sequential shift register, e.g. from the $(k+1)^{th}$ horizontal shift register 4, is in a logical high stage. As illustrated in FIG. 7, when second active device 20 and third active device 30 are disabled by the $(k+1)^{th}$ horizontal shift register 4, fourth active device 40 may be enabled. If pixel 8 has its scan line enabled, current will flow through data current line 5. Additionally, capacitor 60 will be charged, storing $V_{GS}$.

During a pixel current reproducing stage, a scan line connected to each pixel may be provided with an enabling signal or pathway. Each enabled pixel 8 may then emit light in the presence of current in the data line, e.g. when the scan line is in a low state. In a preferred embodiment, each pixel emits light in proportion to the current in the data line.

It will be understood that various changes in the details, materials, and arrangements of the parts which have been described and illustrated above in order to explain the nature of this invention may be made by those skilled in the art without departing from the principle and scope of the invention as recited in the appended claims.

I claim:

1. A method of controlling current to a pixel, comprising:

a. connecting a separate data driver to each output of a horizontal shift register, each data driver further comprising a $V_{GS}$ storage device and a switching circuit operatively connected to the output of the horizontal shift register;

b. connecting each data driver to a digital data controlling current source/sink;

c. providing a digital logic signal from each output of the horizontal shift register to each corresponding data driver;

d. providing a digital control signal from the digital data controlling current source/sink to each corresponding data driver;

e. allowing current to flow through each data driver to the digital data controlling current source/sink upon the presence of a high digital signal from the digital data controlling current source/sink at that data driver;

f. allowing current to be impeded through each data driver to the digital data controlling current source/sink upon the presence of a low digital signal from the digital data controlling current source/sink at that data driver;

g. maintaining a gate-to-source voltage $V_{GS}$ at a predetermined transistor component of each switching circuit upon the high digital signal from the digital data controlling current source/sink at that data driver; and h. allowing the gate-to-source voltage $V_{GS}$ at the predetermined transistor component of each switching circuit to discharge upon the low digital signal from the digital data controlling current source/sink at that data driver.

2. A method of controlling current to a pixel, comprising:

a. providing a sampling stage, further comprising controlling current in a $V_{GS}$ storage device portion of a driver based on the presence of a digital signal of an output of a digital data controlling current source/sink device operatively connected to the drive; the driver further comprising an input and an output operatively connected to a data line;

b. providing a data current outputting stage, further comprising providing current from the driver to a pixel operatively connected to the data line; and c. providing a pixel current reproducing stage, further comprising operatively connecting a scan line to the pixel and allowing the pixel to emit light in the presence of current in the data line when the scan line is in at least one of (i) a high state or (ii) a low state.

3. The method of claim 2, the driver further comprising a switching circuit, the switching circuit further comprising an input and an output, wherein providing the sampling stage further comprises:

a. operatively connecting the digital data controlling current source/sink to the switching circuit;

b. providing a control signal from an output of a shift register, the shift register comprising at least one output, to a corresponding input of the switching circuit;

c. allowing current to flow through the switching circuit in the presence of a digital high signal of the digital data controlling current source/sink;

d. charging the $V_{GS}$ storage device in the presence of the digital high signal of the digital data controlling current source/sink; and e. discharging the $V_{GS}$ storage device in the presence of a digital low signal of the digital data controlling current source/sink to a level below which the switching circuit will be disabled.

4. The method of claim 3, further comprising:

a. providing the data sampling stage when the data signal from the shift register for the driver is in a logical low state and the data signal from an output of a previous sequential shift register is in a logical high state; and b. providing the data current outputting stage for the driver when the data signal from the shift register for the driver is in a logical low state and the data signal from an output of the next sequential shift register is in a logical high state.

5. The method of claim 2, wherein providing the data current outputting stage further comprises:

a. connecting a plurality of switching circuits to the data line;

b. summing current from each of the plurality of switching circuits operatively connected to the data line; and c. providing the summed current to a pixel operatively connected to the data line.

6. The method of claim 2, wherein:

a. each pixel emits light in proportion to the current in the data line.

7. The method of claim 2, wherein;

a. the pixel is an organic light emitting diode pixel.

8. A method of controlling current to a pixel, comprising:

a providing a sampling stage, further comprising controlling current in a $V_{GS}$ storage device portion of a driver based on the presence of a digital signal of an output of a digital data controlling current source/sink device operatively connected to the driver, the driver further comprising an input and an output operatively connected to a data line, and a switching circuit comprising an input and an output;

b. operatively connecting the digital data controlling current source/sink to the switching circuit;

c. providing a control signal from an output of a shift register, the shift register comprising at least one output, to a corresponding input of the switching circuit;

d. allowing current to flow through the switching circuit in the presence of a digital high signal of the digital data controlling current source/sink;

e. charging the $V_{GS}$ storage device in the presence of the digital high signal of the digital data controlling current source/sink;

f. discharging the $V_{GS}$ storage device in the presence of a digital low signal of the digital data controlling current source/sink to a level below which the switching circuit will be disabled;

g. providing a data current outputting stage, further comprising providing current from the driver to a pixel operatively connected to the data line; and h. providing a pixel current reproducing stage, further comprising operatively connecting a scan line to the pixel and allowing the pixel to emit light in the presence of current in the data line when the scan line is in at least one of (i) a high state or (ii) a low state.

9. A method of controlling current to a pixel, comprising:

a. providing a sampling stage, further comprising controlling current in a $V_{GS}$ storage device portion of a driver based on the presence of a digital signal of an output of a digital data controlling current source/sink device operatively connected to the driver, the driver further comprising an input and an output operatively connected to a data line;

b. providing a data current outputting stage, further comprising providing current from the driver to a pixel operatively connected to the data line, connecting a plurality of switching circuits to the data line, summing current from each of the plurality of switching circuits operatively connected to the data line and providing the summed current to a pixel operatively connected to the data line; and c. providing a pixel current reproducing stage, further comprising operatively connecting a scan line to the pixel and allowing the pixel to emit light in the presence of current in the data line when the scan line is in at least one of(i) a high state or (ii) a low state.

* * * * *